US010310446B2

(12) United States Patent
Josiah et al.

(10) Patent No.: US 10,310,446 B2
(45) Date of Patent: Jun. 4, 2019

(54) METHOD FOR CONVERTING A TONER CARTRIDGE PRINTER TO A SUBLIMATION TONER PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 23 days.

(21) Appl. No.: 15/800,482

(22) Filed: Nov. 1, 2017

(65) Prior Publication Data

US 2018/0052421 A1 Feb. 22, 2018

Related U.S. Application Data

(63) Continuation-in-part of application No. 15/408,186, filed on Jan. 17, 2017, now Pat. No. 9,835,968, which
(Continued)

(51) Int. Cl.
*G03G 21/16* (2006.01)
*G03G 15/01* (2006.01)
(Continued)

(52) U.S. Cl.
CPC ..... *G03G 21/1676* (2013.01); *G03G 15/0121* (2013.01); *G03G 15/0178* (2013.01);
(Continued)

(58) Field of Classification Search
CPC ..... G03G 15/1685; G03G 15/0121; G03G 15/01; G03G 15/0178; G03G 15/0863; G03G 15/556
See application file for complete search history.

(56) References Cited

U.S. PATENT DOCUMENTS 4,630,076 A 12/1986 Yoshimura
4,943,506 A 7/1990 Demizu et al.
(Continued)

FOREIGN PATENT DOCUMENTS

EP 0280378 3/1995
WO 2014206673 12/2014

OTHER PUBLICATIONS

Robert-Bosch; Digital Transfer Media for Printers with White Toner; website; Oct. 29 2014; 8 pages; Forever GmbH Digital Transfer Applications Technology; Heddesheim, Germany; http://www.seri-deco.fi/files/FOREVER%20No-Cut_white%20toner%20flyer.pdf.

(Continued)

*Primary Examiner* — David M. Gray
*Assistant Examiner* — Jessica L Eley
(74) *Attorney, Agent, or Firm* — Kevin Schraven; Anooj Patel; Hankin Patent Law, APC

(57) ABSTRACT

A method of converting a standard CMYK color toner printer to a CMYK or CMYW sublimation color toner printer. Providing a standard CMYK color toner printer, comprising four toner printing cartridges: a cyan toner printing cartridge, a magenta toner printing cartridge, a yellow toner printing cartridge, and a black toner printing cartridge. Removing the four toner printing cartridges, such that four empty toner cartridge slots are created. Providing four sublimation toner printing cartridges: a cyan sublimation toner printing cartridge, a magenta sublimation toner printing cartridge, a yellow sublimation toner printing cartridge, and a black sublimation toner printing cartridge, or a white sublimation toner printer cartridge. Installing the four sublimation toner printing cartridges into the four empty toner cartridge slots.

32 Claims, 6 Drawing Sheets

Related U.S. Application Data is a continuation-in-part of application No. 15/286,875, filed on Oct. 6, 2016, now Pat. No. 9,835,981, application No. 15/800,482, which is a continuation-in-part of application No. 15/286,943, filed on Oct. 6, 2016, now Pat. No. 9,835,982, and a continuation-in-part of application No. 15/286,998, filed on Oct. 6, 2016, now Pat. No. 9,835,983, said application No. 15/286,875 is a continuation-in-part of application No. 14/879,548, filed on Oct. 9, 2015, now Pat. No. 9,488,932, which is a continuation-in-part of application No. 14/731,785, filed on Jun. 5, 2015, now Pat. No. 9,383,684.

(60) Provisional application No. 62/470,639, filed on Mar. 13, 2017.

(51) Int. Cl.
*G03G 15/08* (2006.01)
*G03G 15/00* (2006.01)

(52) U.S. Cl.
CPC ..... *G03G 15/0863* (2013.01); *G03G 15/0894* (2013.01); *G03G 15/6585* (2013.01); *G03G 15/0867* (2013.01); *G03G 2215/00987* (2013.01)

(56) References Cited

U.S. PATENT DOCUMENTS

| | | | | |
|---|---|---|---|---|
| 5,223,906 | A | 6/1993 | Harris | |
| 5,367,327 | A | 11/1994 | Harris | |
| 6,114,077 | A | 9/2000 | Voets et al. | |
| 6,203,953 | B1 | 3/2001 | Dalal | |
| 6,249,655 | B1 | 6/2001 | Baek et al. | |
| 6,535,712 | B2 | 3/2003 | Richards | |
| 6,640,843 | B2 | 11/2003 | Lee | |
| 6,769,766 | B2 | 8/2004 | Suzuki et al. | |
| 6,975,428 | B1 | 12/2005 | Ernst | |
| 7,061,503 | B2 | 6/2006 | Newman | |
| 7,134,749 | B2 | 11/2006 | Ben-Zur et al. | |
| 7,261,390 | B2 | 8/2007 | Nishino | |
| 7,591,456 | B2 * | 9/2009 | Connors | B65H 3/50 271/3.14 |
| 7,717,532 | B2 | 5/2010 | Kroon et al. | |
| 8,205,981 | B1 | 6/2012 | Marino et al. | |
| 8,298,737 | B2 | 10/2012 | Kadokura | |
| 8,348,399 | B2 | 1/2013 | Gengrinovich | |
| 8,351,100 | B2 | 1/2013 | Mestha et al. | |
| 8,599,436 | B2 | 12/2013 | Sano et al. | |
| 8,728,696 | B2 | 5/2014 | Yamada | |
| 8,735,320 | B2 | 5/2014 | La Costa | |
| 8,784,508 | B2 | 7/2014 | Ellis | |
| 8,851,641 | B2 | 10/2014 | Kamiyama | |
| 2004/0037573 | A1 | 2/2004 | Hirota | |
| 2004/0252173 | A1 | 12/2004 | Ben-Zur et al. | |
| 2005/0264632 | A1 | 12/2005 | Glass et al. | |
| 2005/0271401 | A1 | 12/2005 | Burchette et al. | |
| 2006/0034509 | A1 | 2/2006 | Lu et al. | |
| 2006/0162586 | A1 | 7/2006 | Fresener et al. | |
| 2008/0218539 | A1 | 9/2008 | Hill et al. | |
| 2008/0253819 | A1 * | 10/2008 | Shimizu | B41J 2/325 399/405 |
| 2008/0292332 | A1 | 11/2008 | Okano | |
| 2009/0040249 | A1 | 2/2009 | Wouters | |
| 2010/0177366 | A1 | 7/2010 | Mestha | |
| 2012/0051816 | A1 | 3/2012 | Chiyoda | |
| 2012/0189337 | A1 | 7/2012 | Takemura | |
| 2013/0004742 | A1 * | 1/2013 | La Costa | B41J 2/0057 428/195.1 |
| 2013/0078001 | A1 | 3/2013 | Koido | |
| 2013/0108345 | A1 | 5/2013 | Yamamoto | |
| 2013/0113854 | A1 | 5/2013 | Iwata | |
| 2013/0235398 | A1 | 9/2013 | Bhatti et al. | |
| 2013/0251411 | A1 | 9/2013 | Miura | |
| 2013/0308985 | A1 | 11/2013 | Kim | |
| 2013/0330522 | A1 | 12/2013 | Suzuki et al. | |
| 2014/0056617 | A1 | 2/2014 | Rimai et al. | |
| 2014/0292855 | A1 | 8/2014 | Chang | |

OTHER PUBLICATIONS

Anthony Dinezza; Can a Printer Print White Color; website forum; Apr. 15, 2014; 3 pages; http://superuser.com/questions/663316/can-a-printer-print-white-color.

T-Shirt Forums; Okidata Laser with White Toner; website forum; Jan. 4, 2013; 7 pages; http://www.t-shirtforums.com/laser-heat-transfer-paper/t209046.html.

Top Useful Solutions; DIY White Toner Laser Printer; website forum; Mar. 20, 2015; 4 pages; http://topusefulsolutions.com/10813/diy-white-toner-laser-printer.

Heat Press Nation; White Toner; website; 5 pages; Brea, California; http://www.heatpressnation.com/catalogsearch/result/?q=white+toner&x=0&y=0.

Inkfilling; White Toner; website forum; 2 pages; Irwindale, California; https://www.inkfilling.com/inquiries/thread_1933.html.

Alibaba; White Toner; website; Feb. 9, 2016; 2 pages; China; http://sourcing.alibaba.com/rfq_search_list.htm?fsb=y&IndexArea=rfq_en&CatId=&SearchText=white+toner.

Superuser; What will happen if i put colored toner in Black white laser printer cartridge; website forum; Jan. 20, 2010; 2 pages; http://superuser.com/questions/98147/what-will-happen-if-i-putcolored-toner-in-black-white-laser-printer-cartridge.

Superuser; Can I refill monochrome laser printer cartridge with color powder; website forum; Jan. 3, 2015; 2 pages; http://superuser.com/questions/860019/can-i-refill-monochrome-laserprinter-cartridge-with-color-powder.

Denis Cormier, et al.; Experiments in Layered Electro-Photographic Printing; manuscript; 7 pages; North Carolina State University; Raleigh, North Carolina; http://sffsymposium.engr.utexas.edu/Manuscripts/2000/2000-33-Cormier.pdf.

Graphics One; OKI pro920WT White Toner Solution; catalog; 2 pages; http://www.graphicsone.com/stage/media/catalog/product/PDFs/920%20WT%20Quick%20FAQs.pdf.

Wikipedia; Toner refill; website; Apr. 29, 2015; 3 pages; http://en.wikipedia.org/wiki/Toner_refill.

Uni-Kit; Toner Refill Instructions; manual; 142 pages; Easy Group; http://www.refillinstructions.com/tonerrefillinstructions.pdf.

GCTECH; 4 pack toner refill kit; website; Nov. 12, 2008; 6 pages; Amazon; http://www.amazon.com/Refill-LaserJet-2605DTN-Cartridges-INCLUDES/dp/B001L1A1DS.

Florent Pellegrin; Refilling method for ink jet cartridges; manual; 2007; 252 pages; Thailand; http://www.refillinstructions.com/GeneralRefill.pdf.

Walmart; Ink Refill Kit; website; 4 pages; http://www.walmart.com/c/ep/ink-refill-kit.

Alibaba; White Ink Refill; website; 8 pages; China; http://www.alibaba.com/showroom/white-ink-refill.html.

Print Country; Printer Ink Cartridges Refill Kit Troubleshooting; website; Lihua, Hawaii; 6 pages; http://www.printcountry.com/faq-troubleshooting-refill-kits.asp.

Coldesi Colman; Viper DTG Printer Training Videos—Filling Machine With Ink; video; Mar. 7, 2013; https://www.youtube.com/watch?v=sLyN8fCoy9Q.

Pantograms; Make More Money with our Stitch-n-Print Solutions Combining Embroidery With White Toner Laser Printers; website article; Tampa, Florida; 5 pages; http://www.pantograms.com/stitchnprintembroideryandheattransfers.asp.

Automatic Transfer, Inc.; White Sublimation Laser Toner; website; Alpha, New Jersey; 3 pages; http://www.atttransfer.com/whitetoner.html.

The Recycler; OKI's white toner technology wins awards; website article; Mar. 22, 2013; 2 pages; http://www.therecycler.com/posts/okis-white-toner-technology-winsawards/.

(56) References Cited

OTHER PUBLICATIONS

Print Planet; The 5th Toner; website forum; Apr. 6, 2012; 2 pages; http://printplanet.com/forums/digital-printing-discussion/28580-5thtoner.
Durst Tau 150 8C; High Speed Digital UV Inkject Label Press; YouTube video; Dec. 21, 2011; https://www.youtube.com/watch?v=va8KwofWDus.
Epson; WT7900 White Based Printing Technology; website; https://www.epson.com/cgibin/Store/jsp/Pro/SeriesStylusProWT7900/Overview.do?UseCookie=yes.
Oce; Oce White Ink Technology; website; Canon; http://global.oce.com/technologies/white-ink-technology.aspx.
Smartpress; White Ink Printing; website; http://smartpress.com/pages/white-ink-printing.
Mark Ritchie; UV White Inkjet Inks for Single-Pass Label Applications; brochure; Jan. 4, 2015; Xaar; http://www.xaar.com/en/MediaDocuments/UV-inks-white-paper.pdf.
Tshirt Forum; OKI Tabloid Printer with White Toner; website forum; May 18, 2013; http://www.t-shirtforums.com/printers-inks-inkjet-laser-transfers/t151402-12.html.
Korean Intellectual Property Office, International Search Report, dated Aug. 31, 2016, 3 pages.
Korean Intellectual Property Office, Written Opinion of the International Searching Authority, dated Aug. 31, 2016, 4 pages.
Korean Intellectual Property Office, Notification concerning Transmittal of International Preliminary Report on Patentability, dated Dec. 14, 2017, 1 page.
Korean Intellectual Property Office, International Preliminary Report on Patentability, dated Jun. 3, 2016, 5 pages.

* cited by examiner

METHOD FOR CONVERTING A TONER CARTRIDGE PRINTER TO A SUBLIMATION TONER PRINTER

CROSS-REFERENCE TO RELATED APPLICATIONS

This patent application takes priority from U.S. Provisional Patent Application No. 62/470,639, filed on Mar. 13, 2017, titled, Toner Cartridge Printer Devices, Systems, and Methods, by co-inventors Michael Raymond Josiah and Joseph Dovi, the contents of which are expressly incorporated herein by this reference as though set forth in their entirety and to which priority is claimed. This patent application is also a Continuation-in-Part of U.S. Non-Provisional patent application Ser. Nos.: (1) Ser. No. 15/408,186, filed on Jan. 17, 2017, titled, Toner Cartridge Printer Devices, Systems, and Methods For Over Printing and Under Printing, by co-inventors Michael Raymond Josiah and Joseph Dovi; (2) Ser. No. 15/286,998, filed on Oct. 6, 2016, titled, Method and System for Converting a Toner Cartridge Printer to a Double White Toner Printer, by co-inventors Michael Raymond Josiah and Joseph Dovi; (3) Ser. No. 15/286,943, filed on Oct. 6, 2016, titled Method And System For Converting A Toner Cartridge Printer To A White, Clear, Metallic, Fluorescent, Or Light Toner Printer, by co-inventors Michael Raymond Josiah and Joseph Dovi; the contents of all three of which are expressly incorporated herein by this reference as though set forth in their entirety and to which priority is claimed. U.S. Non-Provisional patent application Ser. No. 15/408,186 is a Continuation-in-Part Application of U.S. Non-Provisional patent application Ser. No. 15/286,875, filed on Oct. 6, 2016, titled, Method and System for Converting a Toner Cartridge Printer to a Metallic, Clear Fluorescent, or Light Toner Printer, by co-inventors Michael Raymond Josiah and Joseph Dovi, the contents of which are expressly incorporated herein by this reference as though set forth in their entirety and to which priority is claimed, U.S. Non-Provisional patent application Ser. No. 15/286,875 is a Continuation-in-Part of U.S. Non-Provisional patent application Ser. No. 14/879,548, now U.S. Pat. No. 9,488,932, filed on Oct. 9, 2015, titled, Method and System for Converting a Toner Cartridge Printer to a White, Clear, or Fluorescent Toner Printer, by co-inventors Michael Raymond Josiah and Joseph Dovi, the contents of which are expressly incorporated herein by this reference as though set forth in their entirety and to which priority is claimed. U.S. Non-Provisional patent application Ser. No. 14/879,548 is a Continuation-in-Part of U.S. Non-Provisional patent application Ser. No. 14/731,785, now U.S. Pat. No. 9,383,684, filed on Jun. 5, 2015, titled, Method and System for Converting a Toner Cartridge Printer to a White Toner Printer, by co-inventors Michael Raymond Josiah and Joseph Dovi, the contents of which are expressly incorporated herein by this reference as though set forth in their entirety and to which priority is claimed. The patent application is also a Continuation-in-Part Application.

FIELD OF USE

The present disclosure relates generally to printer cartridge replacement. More specifically, this disclosure relates to methods and systems of converting a standard toner cartridge printer to a printer that prints with sublimation toner.

BACKGROUND

Traditional Cyan (C), Magenta (M), Yellow (Y), and Black (K) (or CMYK) laser or Light Emitting Diode (LED)

type printers come standard with Cyan, Magenta, Yellow, and Black toner and/or drum cartridges. However, traditional black toner printers and CMYK toner printers are generally used in surface printing of materials, including direct-to-fabric printing, but do not become part of the fabric like dye sublimation printings does.

Dye sublimation printing works by heating a special type of solid ink. This is different from traditional printing techniques, such as traditional inkjet, CMYK laser, or LED type printers, which spray liquid ink onto a page or surface, staining it (as in the case of inkjet) or transferring a dry ink (toner) to a page or surface and heat pressing the toner into the page or surface. Instead, dye sublimation printing heats up the solid ink, causing it to turn into gas vapors. These vapors make their way into the target surface, where they then turn back into solid form. The target surface may be transfer paper, which is coupled to a piece of polyester or another synthetic fabric, and then fed through heated rollers that combine heat with pressure to expand the cells of the fabric and convert the dye to a gaseous state. The dye is sublimated into the open pores of the polymeric synthetic materials, and as it cools again, traps the sublimated dye within the cells of the fabric. Because the dye became gaseous, it does not create a dot pattern during the sublimation process like traditional printing techniques, rather it creates a continuous tone print that creates brighter and smoother color variations and transitions, and a superior overall look.

Thus, there is a need for a method for converting or retrofitting a standard CMYK (four cartridge) or CMYKW (five cartridge) toner printer to print using sublimation toner.

SUMMARY OF EMBODIMENTS

To minimize the limitations in the cited references, and to minimize other limitations that will become apparent upon reading and understanding the present specification, the toner cartridge printer methods disclosed herein preferably allow a user to convert a standard printer into one that prints using sublimation toner.

In various embodiments, the methods may be used to convert a traditional toner cartridge(s) and/or drum(s) printing machine to a printing machine that prints sublimation toner from one or more of the toner cartridge(s).

One embodiment may be a method of converting a standard CMYK color toner printer to a CMYK sublimation color toner printer. A standard CMYK color toner printer may be provided and may comprise four toner printing cartridges. The four toner printing cartridges may comprise a cyan toner printing cartridge, a magenta toner printing cartridge, a yellow toner printing cartridge, and a black toner printing cartridge. The four toner printing cartridges may be removed such that four empty toner cartridge slots are created, and may comprise a cyan toner cartridge slot, a magenta toner cartridge slot, a yellow toner cartridge slot, and a black toner cartridge slot. Four sublimation toner printing cartridges may be provided and may comprise a cyan sublimation toner printing cartridge, a magenta sublimation toner printing cartridge, a yellow sublimation toner printing cartridge, and a black sublimation toner printing cartridge. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The black sublimation toner printing cartridge may be installed into the black toner cartridge slot. A print job may be printed onto a transfer material and the print job may be transferred to a final print surface via a heat transfer. The four sublimation toner printing cartridges may comprise disassembling the four toner printing cartridges, emptying and cleaning the four toner printing cartridges, such that four empty printing cartridges may be created, and filling the four empty printing cartridges with four sublimation toners: a cyan sublimation toner, a magenta sublimation toner, a yellow sublimation toner, and a black sublimation toner.

Another embodiment may be a method of converting a standard CMYK color toner printer to a CMYW sublimation color toner printer. A standard CMYK color toner printer may be provided and may comprise four toner printing cartridges. The four toner printing cartridges may comprise a cyan toner printing cartridge, a magenta toner printing cartridge, a yellow toner printing cartridge, and a black toner printing cartridge. The four toner printing cartridges may be removed such that four empty toner cartridge slots are created and may comprise a cyan toner cartridge slot, a magenta toner cartridge slot, a yellow toner cartridge slot, and a black toner cartridge slot. The black toner cartridge slot may be a fourth toner cartridge slot. Four sublimation toner printing cartridges may be provided and may comprise a cyan sublimation toner printing cartridge, a magenta sublimation toner printing cartridge, a yellow sublimation toner printing cartridge, and a white sublimation toner printing cartridge. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The white sublimation toner printing cartridge may be installed into the fourth toner cartridge slot. Raster image processor (RIP) software may be provided for printing cartridge remapping. A print job may be printed onto a transfer material and the print job may be transferred to a final print surface via a heat transfer. The four sublimation toner printing cartridges may comprise disassembling the four toner printing cartridges, emptying and cleaning the four toner printing cartridges, such that four empty printing cartridges may be created, and filling the four empty printing cartridges with four sublimation toners: a cyan sublimation toner, a magenta sublimation toner, a yellow sublimation toner, and a white sublimation toner.

Another embodiment may be a method of converting a standard CMYK color toner printer to a CMYX sublimation color toner printer. A standard CMYK color toner printer may be provided and may comprise four toner printing cartridges. The four toner printing cartridges may comprise a cyan toner printing cartridge, a magenta toner printing cartridge, a yellow toner printing cartridge, and a black toner printing cartridge. The four toner printing cartridges may be removed such that four empty toner cartridge slots are created and may comprise a cyan toner cartridge slot, a magenta toner cartridge slot, a yellow toner cartridge slot, and a black toner cartridge slot. The black toner cartridge slot may be a fourth toner cartridge slot. At least three sublimation toner printing cartridges may be provided and may comprise a cyan sublimation toner printing cartridge, a magenta sublimation toner printing cartridge, a yellow sublimation toner printing cartridge. A non-standard toner printing cartridge may also be provided. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The non-standard toner printing cartridge may be installed into the fourth toner cartridge slot. Raster image processor (RIP) software may be provided for printing cartridge remapping. A print job may be printed onto a transfer material and the print job may be transferred to a final print surface via a heat transfer. The three sublimation toner printing cartridges may comprise disassembling the three toner printing cartridges, emptying and cleaning the three toner printing cartridges, such that three empty printing cartridges may be created, and filling the three empty printing cartridges with three sublimation toners: a cyan sublimation toner, a magenta sublimation toner, and a yellow sublimation toner. The non-standard toner printing cartridge may comprise disassembling the black toner printing cartridge, emptying and cleaning the black toner printing cartridge, such that an empty printing cartridges may be created, and filling the empty printing cartridges with a non-standard toner. The non-standard toner may be selected from the group of non-standard toners consisting of: white, metallic, fluorescent, light, clear, clear fluorescent, ceramic, and sublimation.

Another embodiment may be a method of converting a standard CMYKW color toner printer to a CMYKW sublimation color toner printer. A standard CMYKW color toner printer may be provided and may comprise five toner printing cartridges. The five toner printing cartridges may comprise a cyan toner printing cartridge, a magenta toner printing cartridge, a yellow toner printing cartridge, a black toner printing cartridge, and a white toner printing cartridge. The five toner printing cartridges may be removed such that five empty toner cartridge slots are created and may comprise a cyan toner cartridge slot, a magenta toner cartridge slot, a yellow toner cartridge slot, a black toner cartridge slot, and a white toner cartridge slot. Five sublimation toner printing cartridges may be provided and may comprise a cyan sublimation toner printing cartridge, a magenta sublimation toner printing cartridge, a yellow sublimation toner printing cartridge, a black sublimation toner printing cartridge, and a white sublimation toner printing cartridge. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The black sublimation toner printing cartridge may be installed into the black toner cartridge slot. The white sublimation toner printing cartridge may be installed into the white toner cartridge slot. Raster image processor (RIP) software may be provided for printing cartridge remapping. A print job may be printed onto a transfer material and the print job may be transferred to a final print surface via a heat transfer. The five sublimation toner printing cartridges may comprise disassembling the five toner printing cartridges, emptying and cleaning the five toner printing cartridges, such that five empty printing cartridges may be created, and filling the five empty printing cartridges with five sublimation toners: a cyan sublimation toner, a magenta sublimation toner, a yellow sublimation toner, a black sublimation toner, and a white sublimation toner. A print job may be printed onto a transfer material wherein a layer of white is overprinted on the print job in a single pass. The print job may be transferred from the transfer material to a final print surface via a heat transfer, such that the layer of white is under the print job on the final print surface.

Another embodiment may be a method of converting a standard CMYKX color toner printer to a CMYKX sublimation color toner printer. A standard CMYKX color toner printer may be provided and may comprise five toner printing cartridges. The five toner printing cartridges may comprise a cyan toner printing cartridge, a magenta toner printing cartridge, a yellow toner printing cartridge, a black toner printing cartridge, and a non-standard toner printing cartridge. The five toner printing cartridges may be removed such that five empty toner cartridge slots are created and may comprise a cyan toner cartridge slot, a magenta toner cartridge slot, a yellow toner cartridge slot, a black toner cartridge slot, and a non-standard toner cartridge slot. At least four sublimation toner printing cartridges may be provided and may comprise a cyan sublimation toner printing cartridge, a magenta sublimation toner printing cartridge, a yellow sublimation toner printing cartridge, and a black sublimation toner printing cartridge. A non-standard toner cartridge may also be provided. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The black sublimation toner printing cartridge may be installed into the black toner cartridge slot. The non-standard toner printing cartridge may be installed into the non-standard toner cartridge slot. Raster image processor (RIP) software may be provided for printing cartridge remapping. A print job may be printed onto a transfer material and the print job may be transferred to a final print surface via a heat transfer. The four sublimation toner printing cartridges may comprise disassembling the four toner printing cartridges, emptying and cleaning the four toner printing cartridges, such that four empty printing cartridges may be created, and filling the four empty printing cartridges with four sublimation toners: a cyan sublimation toner, a magenta sublimation toner, a yellow sublimation toner, and a black sublimation toner. The non-standard toner printing cartridge may comprise disassembling the non-standard toner printing cartridge, emptying and cleaning the toner printing cartridge, such that an empty non-standard printing cartridge may be created, and filling the empty non-standard printing cartridge with a non-standard toner. The non-standard toner may be selected from the group of non standard toners consisting of: white, metallic, fluorescent, light, clear, clear fluorescent, ceramic, and sublimation.

Another embodiment may be a method of converting a standard CMYKW color toner printer to a CMYKW sublimation color toner printer. A standard CMYKW color toner printer may be provided and may comprise five toner printing cartridges. The five toner printing cartridges may comprise a cyan toner printing cartridge, a magenta toner printing cartridge, a yellow toner printing cartridge, a black toner printing cartridge, and a white toner printing cartridge. Four toner printing cartridges may be removed such that four empty toner cartridge slots are created and may comprise a cyan toner cartridge slot, a magenta toner cartridge slot, a yellow toner cartridge slot, and a black toner cartridge slot. Four sublimation toner printing cartridges may be provided and may comprise a cyan sublimation toner printing cartridge, a magenta sublimation toner printing cartridge, a yellow sublimation toner printing cartridge, and a black sublimation toner printing cartridge. The cyan sublimation toner printing cartridge may be installed into the cyan toner cartridge slot. The magenta sublimation toner printing cartridge may be installed into the magenta toner cartridge slot. The yellow sublimation toner printing cartridge may be installed into the yellow toner cartridge slot. The black sublimation toner printing cartridge may be installed into the black toner cartridge slot. Raster image processor (RIP) software may be provided for printing cartridge remapping. A print job may be printed onto a transfer material and the print job may be transferred to a final print surface via a heat transfer. The four sublimation toner printing cartridges may comprise disassembling the four toner printing cartridges, emptying and cleaning the four toner printing cartridges, such that four empty printing cartridges may be created, and filling the four empty printing cartridges with four sublimation toners: a cyan sublimation toner, a magenta sublimation toner, a yellow sublimation toner, and a black sublimation toner. A print job may be printed onto a transfer material wherein a layer of white is overprinted on the print job in a single pass. The print job may be transferred from the transfer material to a final print surface via a heat transfer, such that the layer of white may be under the print job on the final print surface.

Additional embodiments of the invention will be understood from the detailed description of the illustrative embodiments.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
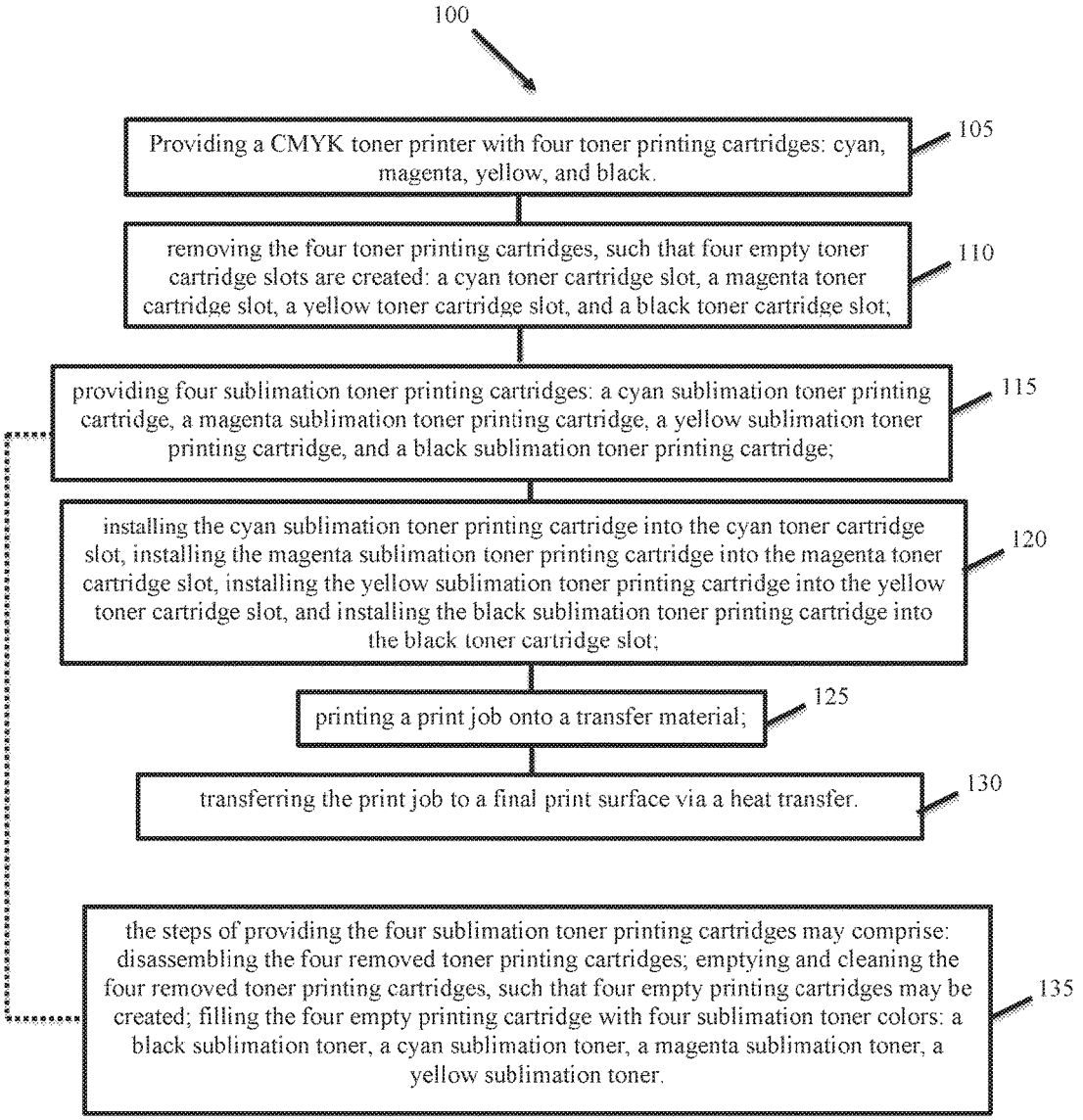
FIG. 1 is a flow block diagram of one embodiment of a method of converting a standard CMYK color toner printer to a CMYK sublimation color toner printer.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

The present specification discloses methods for converting a toner cartridge printer to a sublimation toner printer. The methods for converting a toner cartridge printer to a sublimation toner printer preferably require no special or dedicated printer drivers.

In the following description, certain terminology is used to describe certain features of one or more embodiments. For purposes of the specification, unless otherwise specified, the term "printing cartridge(s)" generally refers to a toner cartridge, a laser toner cartridge, a LEI) toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYK printer, the letter "K" preferably stands for black.

Regarding a CMYKW printer, the letter "W" preferably stands for white, but may also refer to a non-standard toner or toner color, such as white, clear, clear fluorescent, and/or metallic.

Regarding a CMYKX printer, the letter "X" refers to a non-standard toner or toner color, such as white, metallic, fluorescent, light, clear, clear fluorescent, ceramic, and/or sublimation.

The term transfer material may typically refer to a polyurethane media that accepts the toner print job and then allows the print job to be transferred to a final print surface via heat transfer. The transfer material may also be constructed from any suitable material, such as a specially coated paper or even just plain paper. The final print surface is preferably plastic or polymer, such as, for example, a polyester shirt or product.

FIG. 1 is a flow block diagram of one embodiment of a method of converting a standard CMYK color toner printer to a CMYK sublimation color toner printer. As shown in FIG. 1, the method 100 of converting a standard CMYK color toner printer to a CMYK sublimation color toner printer, may comprise providing a standard CMYK color toner printer with four toner printing cartridges: a cyan toner printing cartridge, a magenta toner printing cartridge, a yellow toner printing cartridge, and a black toner printing cartridge 105. Preferably, the CMYK printer is a LED printer.

The CMYK printer provided may have the following configurations:

Configuration 1:
- Black-First
- Yellow-Second
- Magenta-Third
- Cyan-Fourth

Configuration 2:
- Cyan-First
- Magenta-Section
- Yellow-Third
- Black-Fourth

In this configuration, the toner is transferred to the transfer belt first and then to the media.

Configuration 3:
- Yellow-First
- Magenta-Second
- Cyan-Third
- Black-Fourth

In various embodiments, any one of the cartridges may be in any of the four cartridge slots.

In various embodiments, the black toner printing cartridge may be in the fourth toner cartridge slot or the first toner cartridge slot. The cartridges and slots may also be referred to by their position: a first toner cartridge, a second toner cartridge, a third toner cartridge, and a fourth toner cartridge; and a first toner cartridge slot, a second toner cartridge slot, a third toner cartridge slot, and a fourth toner cartridge slot.

The method 100 may further comprise removing the four toner printing cartridges, such that four empty toner cartridge slots are created: a cyan toner cartridge slot, a magenta toner cartridge slot, a yellow toner cartridge slot, and a black toner cartridge slot 110.

Four sublimation toner printing cartridges may be provided. Preferably, the four sublimation toner printing cartridges comprise: a cyan sublimation toner printing cartridge, a magenta sublimation toner printing cartridge, a yellow sublimation toner printing cartridge, and a black sublimation toner printing cartridge 115. The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, and the black sublimation toner printing cartridge may be installed into the black toner cartridge slot 120. The method 100 may further comprise printing a print job onto a transfer material 125. The transfer material may comprise a polyurethane media that accepts the toner print job and then allows the print job to be transferred to a final print surface via heat transfer 130. The final print surface is preferably plastic or polymer, such as, for example, a polyester shirt or product. In some embodiments, the print job may be directly printed onto the final print surface without the need for an intermediate transfer material.

In some embodiments, the steps of providing the four sublimation toner printing cartridges may further comprise: disassembling the four removed toner printing cartridges; emptying and cleaning the four removed toner printing cartridges, such that four empty printing cartridges may be created. The four empty printing cartridges may be filled with four sublimation color toners. Preferably, the four sublimation toners may comprise: a cyan sublimation toner, a magenta sublimation toner, a yellow sublimation toner, and a black sublimation toner 135.

The modified printer may be converted back to a traditional CMYK printer by removing the sublimation toner printing cartridges and/or drum cartridges from the four slots in the CMYK printer and re-installing the regular cyan, yellow, magenta, and black toner printing cartridges and/or drum cartridge into their original positions.

Figure 2:
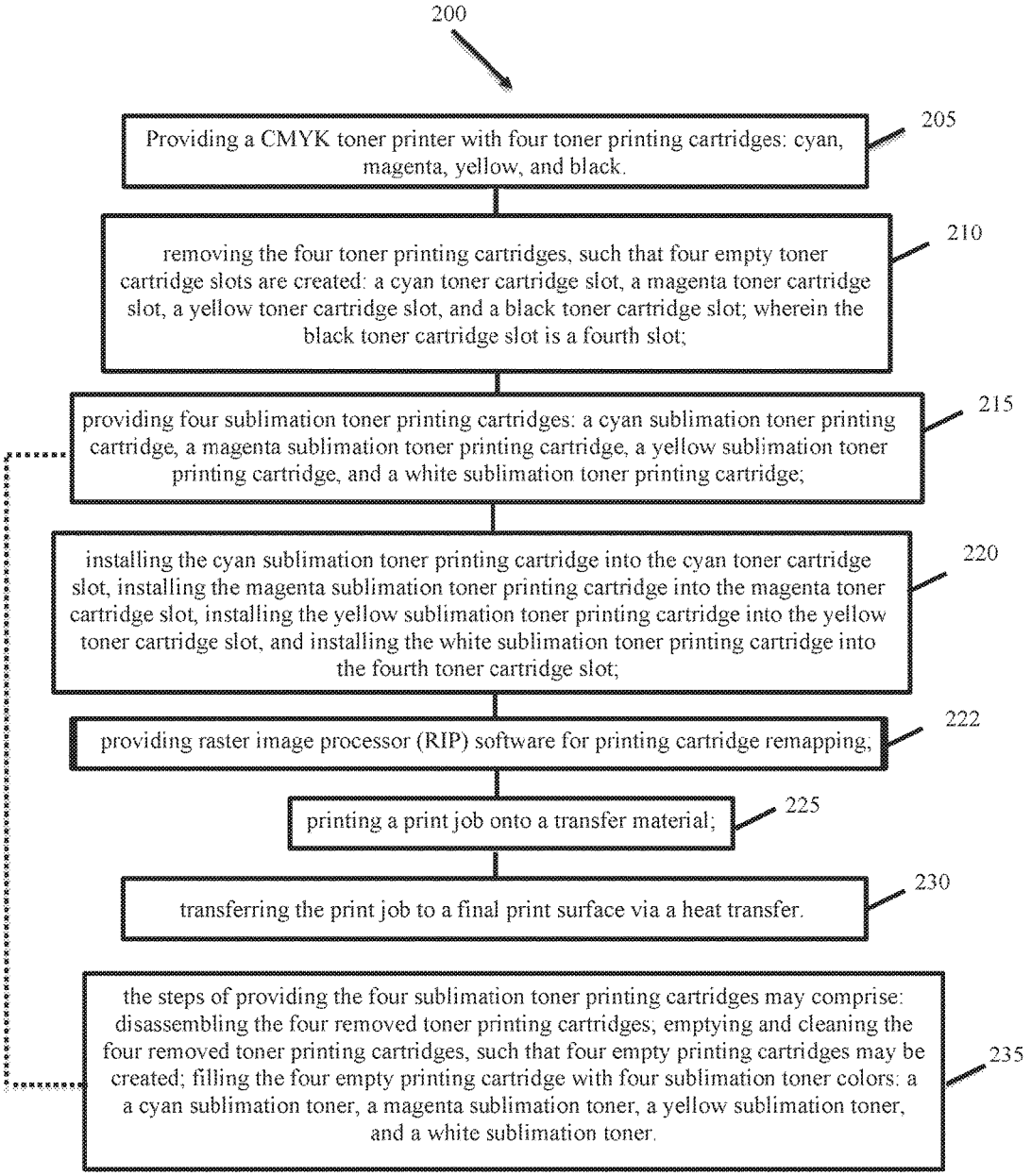
FIG. 2 is a flow block diagram of one embodiment of a method of converting a standard CMYK color toner printer to a CMYW sublimation color toner printer.

FIG. 2 is a flow block diagram of one embodiment of a method of converting a standard CMYK color toner printer to a CMYW sublimation color toner printer. As shown in FIG. 2, the method 200 of converting a standard CMYK color toner printer to a CMYW sublimation color toner printer, may comprise providing a standard CMYK color toner printer with four toner printing cartridges: a cyan toner printing cartridge, a magenta toner printing cartridge, a yellow toner printing cartridge, and a black toner printing cartridge 205. In some embodiments, the CMYK printer may be a LED printer.

The CMYK printer provided may have the following configurations:

Configuration 1:
- Black-First
- Yellow-Second
- Magenta-Third
- Cyan-Fourth

Configuration 2:
- Cyan-First
- Magenta-Section
- Yellow-Third
- Black-Fourth

In this configuration, the toner is transferred to the transfer belt first and then to the media.

Configuration 3:
- Yellow-First
- Magenta-Second
- Cyan-Third
- Black-Fourth

In various embodiments, the black toner printing cartridge may be in the fourth toner cartridge slot or the first toner cartridge slot. The cartridges and slots may also be referred to by their position: a first toner cartridge, a second toner cartridge, a third toner cartridge, and a fourth toner cartridge; and a first toner cartridge slot, a second toner cartridge slot, a third toner cartridge slot, and a fourth toner cartridge slot.

The method 200 may further comprise removing the four toner printing cartridges, such that four empty toner cartridge slots are created: a cyan toner cartridge slot, a magenta toner cartridge slot, a yellow toner cartridge slot, and a black toner cartridge slot 210. In one embodiment, the black toner printing cartridge may be in the fourth toner cartridge slot or the first toner cartridge slot. Three or four sublimation toner printing cartridges may be provided. Preferably, three of the sublimation toner printing cartridges comprise: a cyan sublimation toner printing cartridge, a magenta sublimation toner printing cartridge, and a yellow sublimation toner printing cartridge; the fourth toner printing cartridge may be a white replacement toner printing cartridge 215. In some embodiments, the white replacement toner printing cartridge is regular, non-sublimation specific toner. In other embodiments, the white replacement toner printing cartridge is white sublimation toner.

The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, and the white replacement toner printing cartridge may be installed into the first or fourth toner cartridge slot 220 (depending on the configuration of the printer being converted). The method 200 may further comprise providing raster image processor (RIP) software for printing cartridge remapping 222 and printing a print job onto a transfer material 225. The transfer material may comprise a polyurethane media that accepts the toner print job and then allows the print job to be transferred to a final print surface via heat transfer 230. In some embodiments, the print job may be directly printed/sublimated onto the final print surface without the need for an intermediate transfer material.

In some embodiments, the steps of providing the four sublimation toner printing cartridges may comprise: disassembling the four removed toner printing cartridges; emptying and cleaning the four removed toner printing cartridges, such that four empty printing cartridges may be created. The four empty printing cartridges may be filled with four sublimation toners. The four sublimation toners may comprise: a cyan sublimation toner, a magenta sublimation toner, a yellow sublimation toner, and a white sublimation toner 235.

Alternatively, and preferably, three sublimation toners and one regular toner may be put into the four empty cartridge slots: a cyan sublimation toner, a magenta sublimation toner, a yellow sublimation toner, and a white non-sublimation toner Regarding the RIP software, the RIP software utilizes printing cartridge mapping to enable the ability to move, change or swap printing cartridge locations in the printer. This allows white under printing or over printing in a single pass. The RIP software may also add a customizable separate layer of white either on top or underneath the image depending on the cartridge configuration and printing needs. This fully customizable feature in the software (RIP) allows you to completely reconfigure the printer to get almost any desired effect. However, in a preferred embodiment, a white toner foreground layer may be printed when the white toner is place in the last printing cartridge position.

The RIP software may also be configured to allow the user to print in full color, CMY black, and white, such that the white prints with the other colors at the same time in a single layer. Preferably, the single layer is put down in a single pass. Black may be printed by combining all three of the color print colors.

Figure 3:
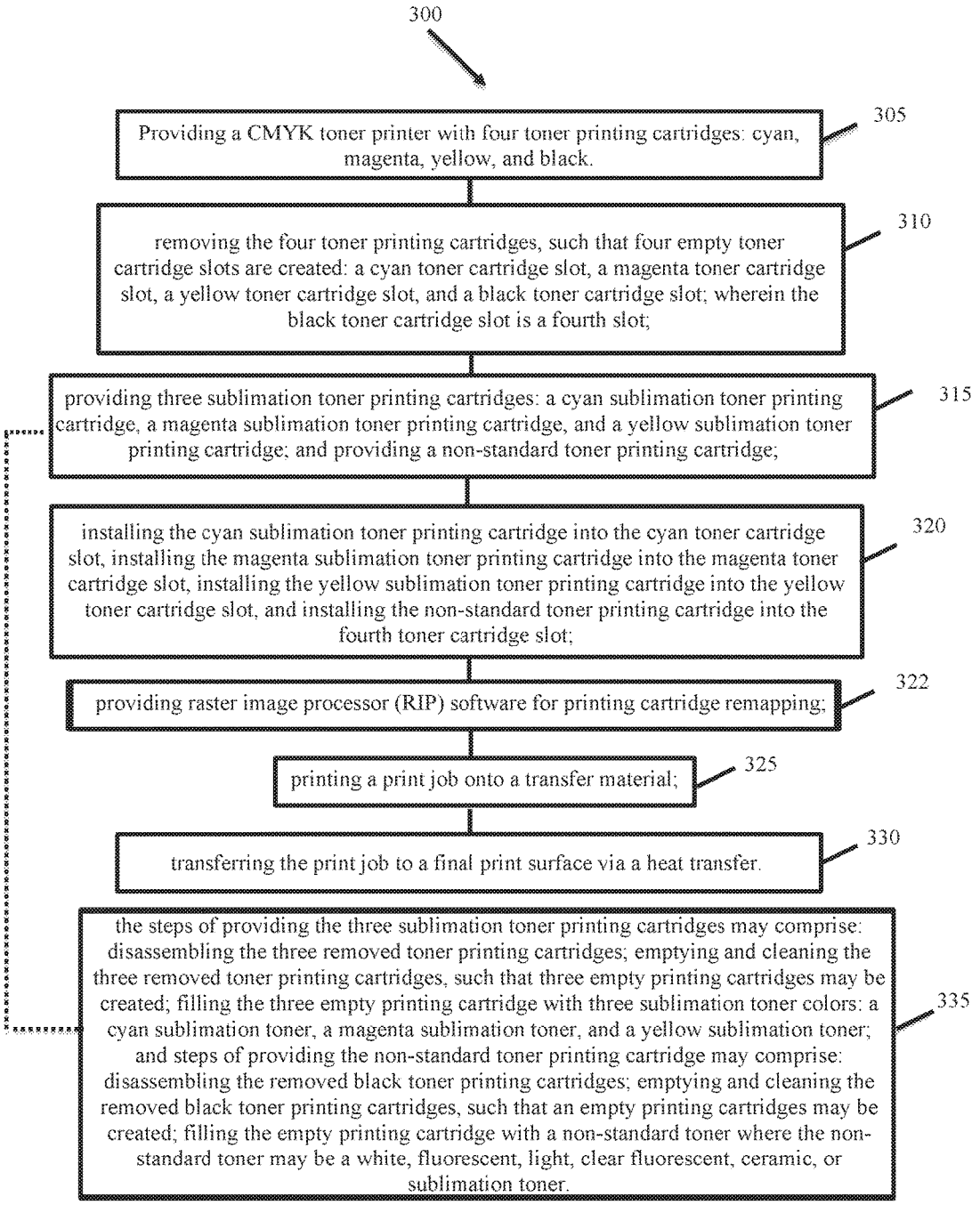
FIG. 3 is a flow block diagram of one embodiment of a method of converting a standard CMYK color toner printer to a CMYX sublimation color toner printer.

FIG. 3 is a flow block diagram of one embodiment of a method of converting a standard CMYK color toner printer to a CMYX sublimation color toner printer. As shown in FIG. 3, the method 300 of converting a standard CMYK color toner printer to a CMYX sublimation color toner printer, may comprise providing a standard CMYK color toner printer with four toner printing cartridges: a cyan toner printing cartridge, a magenta toner printing cartridge, a yellow toner printing cartridge, and a black toner printing cartridge 305. In one embodiment, the CMYK printer may be a LED printer. The method 300 may further comprise removing the four toner printing cartridges, such that four empty toner cartridge slots are created: a cyan toner cartridge slot, a magenta toner cartridge slot, a yellow toner cartridge slot, and a black toner cartridge slot 310. In one embodiment, the black toner printing cartridge may be in the fourth toner cartridge slot. At least three sublimation toner printing cartridges may be provided. Preferably, the three sublimation toner printing cartridges comprise: a cyan sublimation toner printing cartridge, a magenta sublimation toner printing cartridge, and a yellow sublimation toner printing cartridge 315. A non-standard toner printing cartridge may also be provided. The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, and the non-standard toner printing cartridge may be installed into the fourth toner cartridge slot 320.

The method 300 may further comprise providing raster image processor (RIP) software for printing cartridge remapping 322 and printing a print job onto a transfer material 325. The transfer material may comprise a polyurethane media that accepts the toner print job and then allows the print job to be transferred to a final print surface via heat transfer 330. In some embodiments, the print job may be directly printed/sublimated onto the final print surface without the need for an intermediate transfer material.

In some embodiments, the steps of providing the three sublimation toner printing cartridges 335 may comprise: disassembling the three removed toner printing cartridges; emptying and cleaning the three removed toner printing cartridges, such that three empty printing cartridges may be created. The three empty printing cartridges may be filled with three sublimation toners. Preferably, the three sublimation toners may comprise: a cyan sublimation toner, a magenta sublimation toner, and a yellow sublimation toner. The steps of providing the non-standard toner printing cartridge 335 may comprise: disassembling the removed black toner printing cartridges; emptying and cleaning the removed black toner printing cartridges, such that an empty printing cartridge may be created. The empty printing cartridge may be filled with a non-standard toner. Preferably, the non-standard toner may comprise a non-sublimation toner, such as a white toner, a metallic toner, a fluorescent toner, a light toner, a clear toner, a clear fluorescent toner, or a ceramic toner. In one embodiment, the original black toner cartridge that was removed may be put back in along with the three new sublimation toner cartridges.

In some embodiments, the CMYK toner printer provided may be a CMYX toner printer, wherein the X is a non-standard cartridge (as original manufactured, or as previously modified), and X can be white, fluorescent, clear, metallic, ceramic, or a different sublimation. The present disclosure covers taking any existing four or five printer toner cartridges (standard and/or non-standard) and converting it to use other types of printing cartridges (standard and/or non-standard).

Figure 4:
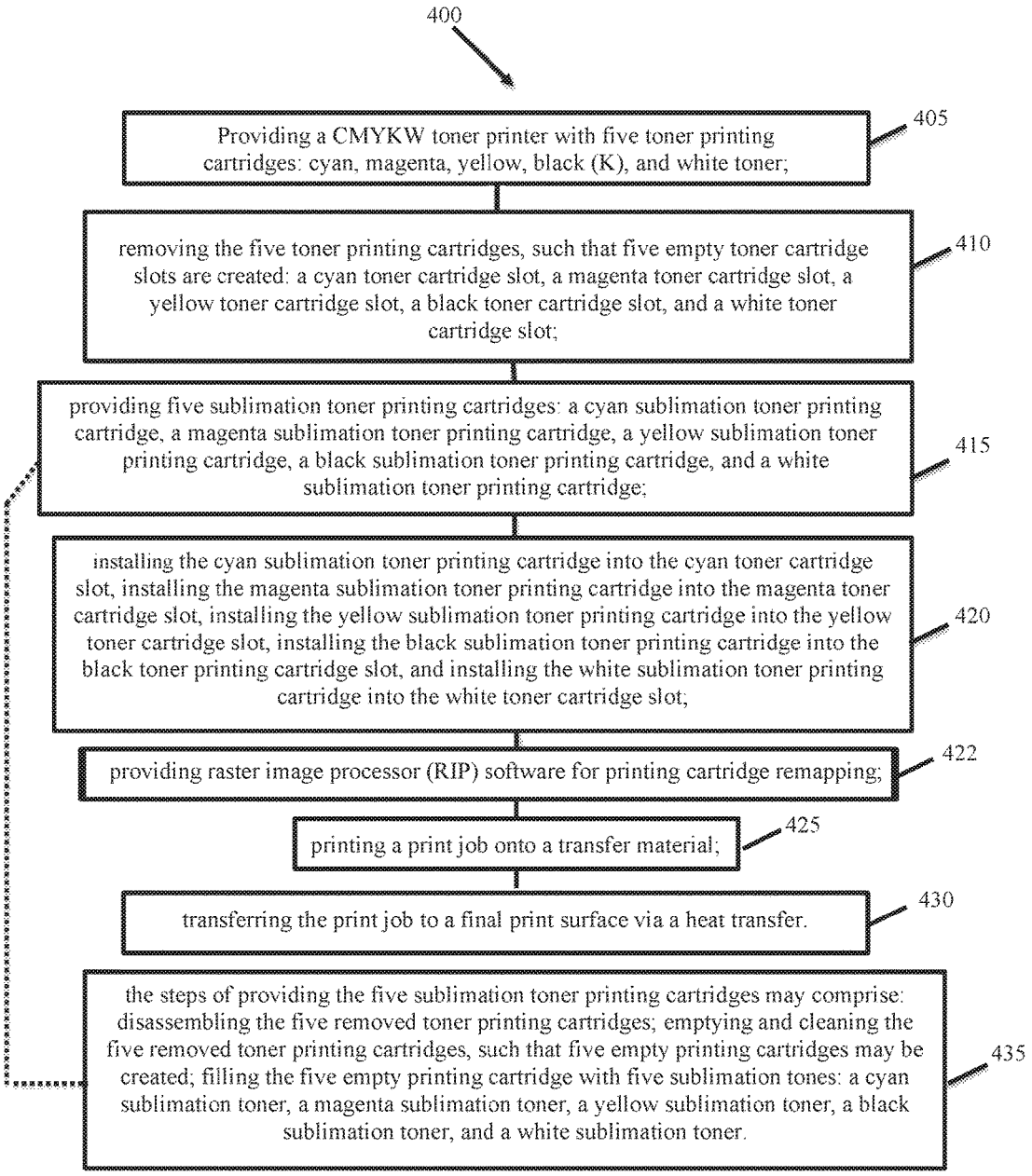
FIG. 4 is a flow block diagram of one embodiment of a method of converting a standard CMYKW color toner printer to a CMYKW sublimation color toner printer.

FIG. 4 is a flow block diagram of one embodiment of a method of converting a standard CMYKW color toner printer to a CMYKW sublimation color toner printer. As shown in FIG. 4, the method 400 of converting a standard CMYKW color toner printer to a CMYKW sublimation color toner printer, may comprise providing a standard CMYKW color toner printer with five toner printing cartridges: a cyan toner printing cartridge, a magenta toner printing cartridge, a yellow toner printing cartridge, a black toner printing cartridge, and a white toner printing cartridge 405. In one embodiment, the CMYKW printer may be a LED printer. The method 400 may further comprise removing five toner printing cartridges, such that five empty toner cartridge slots are created: a cyan toner cartridge slot, a magenta toner cartridge slot, a yellow toner cartridge slot, a black toner cartridge slot, and a white toner cartridge slot 410. In one embodiment, the black toner printing cartridge may be in the fourth toner cartridge slot. Five sublimation toner printing cartridges may be provided. Preferably, the five sublimation toner printing cartridges comprise: a cyan sublimation toner printing cartridge, a magenta sublimation toner printing cartridge, a yellow sublimation toner printing cartridge, a black sublimation toner printing cartridge, and a white sublimation toner printer cartridge 415. The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, the black sublimation toner printing cartridge may be installed into the black toner cartridge slot, and the white sublimation toner printing cartridge may be installed into the white toner cartridge slot 420. The method 400 may further comprise providing raster image processor (RIP) software for printing cartridge remapping 422 (which may be used for over (or even under) printing with white in a single pass). The method 400 may further comprise printing a print job onto a transfer material 425. The transfer material may comprise a polyurethane media that accepts the toner print job and then allows the print job to be transferred to a final print surface via heat transfer 430. In some embodiments, the print job may be directly printed/sublimated onto the final print surface without the need for an intermediate transfer material.

In some embodiments, the steps of providing the five sublimation toner printing cartridges may comprise: disassembling the five removed toner printing cartridges; emptying and cleaning the five removed toner printing cartridges, such that five empty printing cartridges may be created. The five empty printing cartridges may be filled with five sublimation toners. Preferably, the five sublimation toners may comprise: a cyan sublimation toner, a magenta sublimation toner, a yellow sublimation toner, a black sublimation toner, and a white sublimation toner 435.

Another embodiment may be a CMYKW printer that underprints in a single pass, or overprints in a single pass, and/or does both and can be switched back and forth. Overprint printers are useful in providing a clear or white background to an image that is heat transferred to a final surface from a transfer material. Underprint printers are useful in providing a clear or white background to an image that is printed on a non-standard or dark material/surface. The overprint of clear or white may then be the background layer after the image is transferred/sublimated to the final media.

Figure 5:
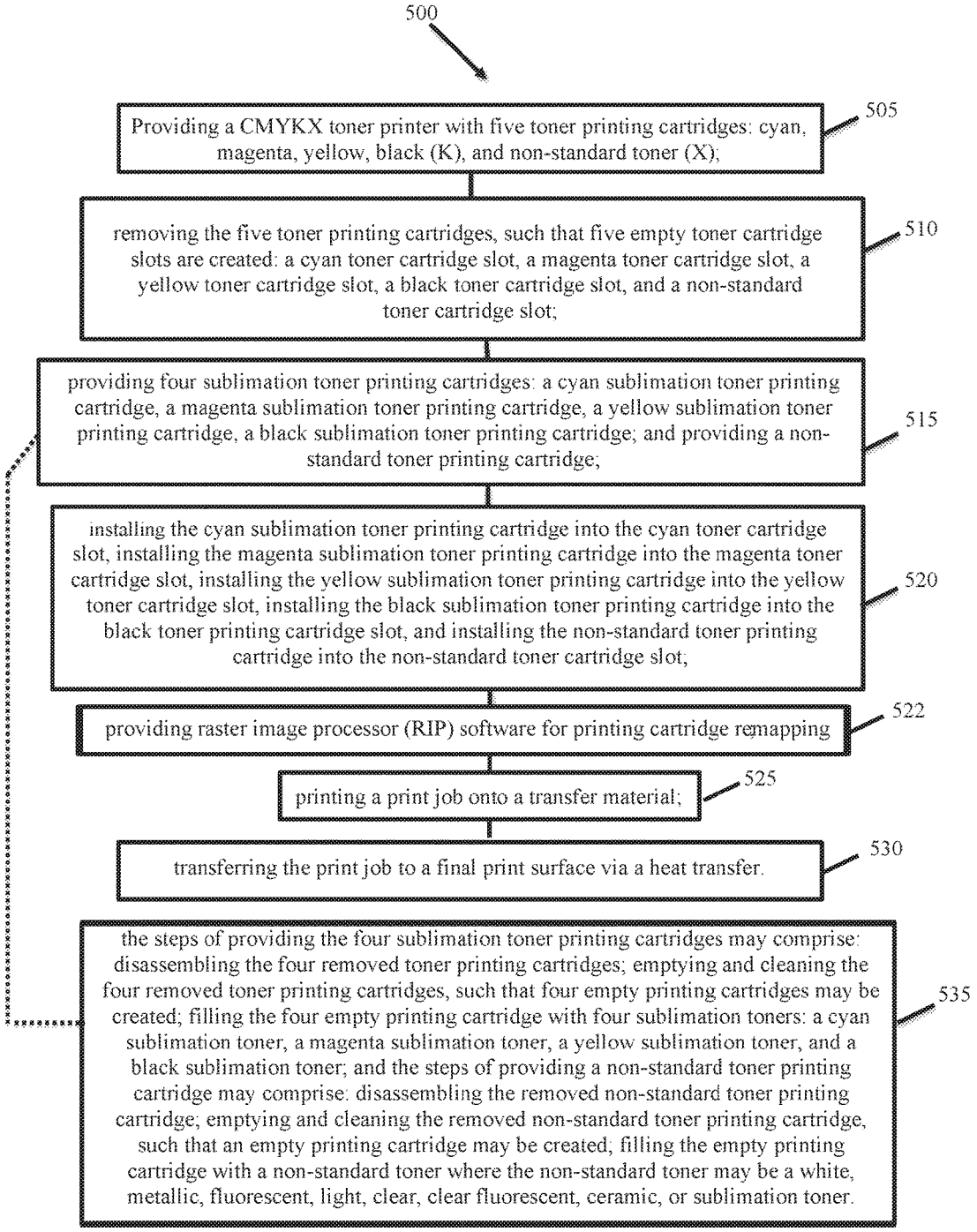
FIG. 5 is a flow block diagram of one embodiment of a method of converting a standard CMYKX color toner printer to a CMYKX sublimation color toner printer.

FIG. 5 is a flow block diagram of one embodiment of a method of converting a standard CMYKX color toner printer to a CMYKX sublimation color toner printer. As shown in FIG. 5, the method 500 of converting a standard CMYKX color toner printer to a CMYKX sublimation color toner printer, may comprise providing a standard CMYKX color toner printer with five toner printing cartridges: a cyan toner printing cartridge, a magenta toner printing cartridge, a yellow toner printing cartridge, a black toner printing cartridge, and a non-standard toner printing cartridge 505. In one embodiment, the CMYKX printer may be a LED printer. The method 500 may further comprise removing five toner printing cartridges, such that five empty toner cartridge slots are created: a cyan toner cartridge slot, a magenta toner cartridge slot, a yellow toner cartridge slot, a black toner cartridge slot, and a non-standard toner cartridge slot 510. In one embodiment, the black toner printing cartridge may be in the fourth toner cartridge slot. At least four sublimation toner printing cartridges may be provided. Preferably, the four sublimation toner printing cartridges comprise: a cyan sublimation toner printing cartridge, a magenta sublimation toner printing cartridge, a yellow sublimation toner printing cartridge, and a black sublimation toner printing cartridge 515, A non-standard toner printing cartridge may also be provided to go in the fifth toner cartridge slot. The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, the black sublimation toner printing cartridge may be installed into the black toner cartridge slot, and the non-standard, but non-sublimation, toner printing cartridge may be installed into the non-standard toner cartridge slot 520. The method 500 may further comprise providing raster image processor (RIP) software for printing cartridge remapping 522 (which may be used for over (or even under) printing with white in a single pass). The method 500 may also comprise printing a print job onto a transfer material 525. The transfer material may comprise a polyurethane media that accepts the toner print job and then allows the print job to be transferred to a final print surface via heat transfer 530. In some embodiments, the print job may be directly printed/sublimated onto the final print surface without the need for an intermediate transfer material.

In some embodiments, the steps of providing the four sublimation toner printing cartridges 535 may comprise: disassembling the four removed toner printing cartridges; emptying and cleaning the four removed toner printing cartridges, such that four empty printing cartridges may be created. The four empty printing cartridges may be filled with four sublimation color toners. Preferably, the four sublimation toners may comprise: a cyan sublimation toner, a magenta sublimation toner, a yellow sublimation toner, and a black sublimation toner. The steps of providing a non-standard toner printing cartridge 535 may comprise: disassembling the removed non-standard toner printing cartridge; emptying and cleaning the removed non-standard toner printing cartridge, such that an empty non-standard printing cartridge may be created. The empty non-standard printing cartridge may be filled with a non-standard toner color. Preferably; the non-standard toner color may comprise: a white toner, a metallic toner, a fluorescent toner, a light toner, a clear toner, a clear fluorescent toner, a sublimation non-standard toner, and/or a ceramic toner. In one embodiment, the original white toner printing cartridge may be put back into place in the fifth toner cartridge slot.

In some embodiments, the X non-standard toner may be in the first, fourth, or fifth toner printing cartridge slot and the black sublimation toner printing cartridge may be in the first, fourth, or fifth toner printing cartridge slot and whichever is not being used by the non-standard toner cartridge. In another embodiment, the X non-standard toner may be in the first, second, third, fourth; or fifth toner printing cartridge slot and the black sublimation toner printing cartridge may be in the first, second, third, fourth, or fifth toner printing cartridge slot.

Another embodiment may be a CMYKX printer that underprints in a single pass, or overprints in a single pass, and/or does both and can be switched back and forth.

Overprint printers are useful in providing a clear or white background to an image that is heat transferred to a final surface from a transfer material. Underprint printers are useful in providing a clear or white background to an image that is printed on a non-standard or dark material/surface. The overprint of clear or white may then be the background layer after the image is transferred/sublimated to the final media.

Figure 6:
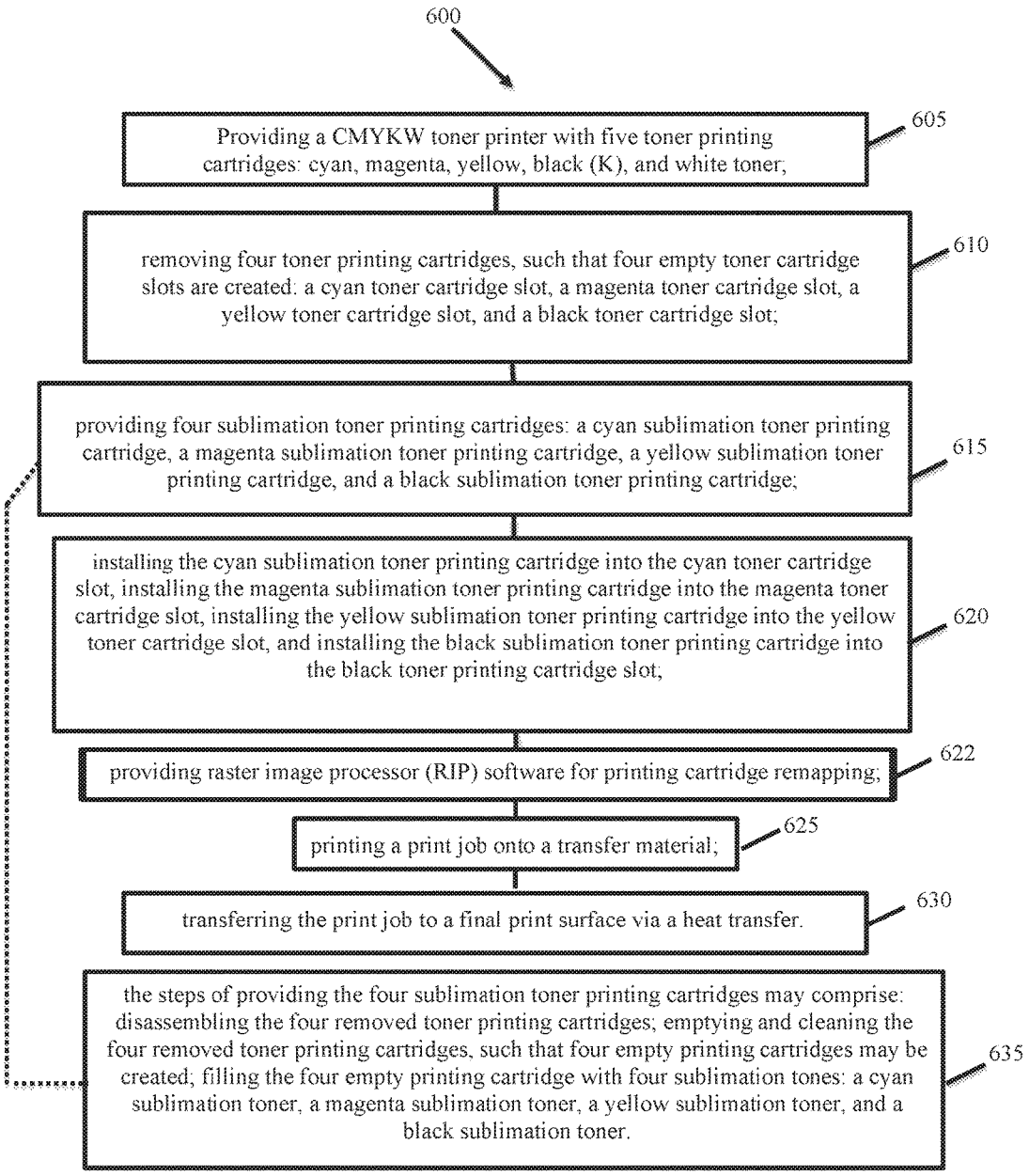
FIG. 6 is a flow block diagram of another embodiment of a method of converting a standard CMYKW color toner printer to a CMYKW sublimation color toner printer.

FIG. 6 is a flow block diagram of one embodiment of a method of converting a standard CMYKW color toner printer to a CMYKW sublimation color toner printer. As shown in FIG. 6, the method 600 of converting a standard CMYKW color toner printer to a CMYKW sublimation color toner printer, may comprise providing a standard CMYKW color toner printer with five toner printing cartridges: a cyan toner printing cartridge, a magenta toner printing cartridge, a yellow toner printing cartridge, a black toner printing cartridge, and a white toner printing cartridge 605. In one embodiment, the CMYKW printer may be a LED printer. The method 600 may further comprise removing four toner printing cartridges, such that four empty toner cartridge slots are created: a cyan toner cartridge slot, a magenta toner cartridge slot, a yellow toner cartridge slot, and a black toner cartridge slot 610. Preferably, the white toner cartridge is not removed, unless it is remapped into another slot. In one embodiment, the black toner printing cartridge may be in the fourth toner cartridge slot. Four sublimation toner printing cartridges may be provided. Preferably, the four sublimation toner printing cartridges comprise: a cyan sublimation toner printing cartridge, a magenta sublimation toner printing cartridge, a yellow sublimation toner printing cartridge, and a black sublimation toner printing cartridge 615. The cyan sublimation toner printing cartridge may be installed into the cyan toner cartridge slot, the magenta sublimation toner printing cartridge may be installed into the magenta toner cartridge slot, the yellow sublimation toner printing cartridge may be installed into the yellow toner cartridge slot, and the black sublimation toner printing cartridge may be installed into the black toner cartridge slot 620. The method 600 may further comprise providing raster image processor (RIP) software for printing cartridge remapping 622 and printing a print job onto a transfer material 625. The transfer material may comprise a polyurethane media that accepts the toner print job and then allows the print job to be transferred to a final print surface via heat transfer 630. In some embodiments, the print job may be directly printed onto the final print surface without the need for an intermediate transfer material.

In some embodiments, the steps of providing the four sublimation toner printing cartridges 635 may comprise: disassembling the four removed toner printing cartridges; emptying and cleaning the four removed toner printing cartridges, such that four empty printing cartridges may be created. The four empty printing cartridges may be filled with four sublimation toners. Preferably, the four sublimation toners may comprise: a cyan sublimation toner, a magenta sublimation toner, a yellow sublimation toner, and a black sublimation toner.

In some embodiments, the X non-standard toner may be in the first, fourth, or fifth toner printing cartridge slot and the black toner printing cartridge may be in the first; fourth, or fifth toner printing cartridge slot and whichever is not being used by the non-standard toner cartridge.

Another embodiment may be a CMYKX printer that underprints in a single pass, or overprints in a single pass, and/or does both and can be switched back and forth.

Overprint printers are useful in providing a clear or white background to an image that is heat transferred to a final surface from a transfer material. Underprint printers are useful in providing a clear or white background to an image that is printed on a non-standard or dark material/surface.

The overprint of white may then be the background layer after the image is transferred/sublimated to the final media.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly; the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a standard CMYK color toner printer to a CMYK sublimation color toner printer, comprising the steps:

providing a standard CMYK color toner printer, comprising four toner printing cartridges:

a cyan toner printing cartridge, a magenta toner printing cartridge, a yellow toner printing cartridge, and a black toner printing cartridge;

removing said four toner printing cartridges, such that four empty toner cartridge slots are created: a cyan toner cartridge slot, a magenta toner cartridge slot, a yellow toner cartridge slot, and a black toner cartridge slot;

providing four sublimation toner printing cartridges: a cyan sublimation toner printing cartridge, a magenta sublimation toner printing cartridge, a yellow sublimation toner printing cartridge, and a black sublimation toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot; and installing said black sublimation toner printing cartridge into said black toner cartridge slot.

2. The method of claim 1, further comprising the steps:

printing a print job onto a transfer material; and transferring said print job to a final print surface via a heat transfer.

3. The method of claim 1, wherein providing said four sublimation toner printing cartridges comprises the steps:

disassembling said four removed toner printing cartridges;

emptying and cleaning said four removed toner printing cartridges, such that four empty printing cartridges are created;

filling said four empty printing cartridges with four sublimation toners: a cyan sublimation toner, a magenta sublimation toner, a yellow sublimation toner, and a black sublimation toner.

4. A method of converting a standard CMYK color toner printer to a CMYW sublimation color toner printer, comprising the steps:

providing a standard CMYK color toner printer, comprising four toner printing cartridges:

a cyan toner printing cartridge, a magenta toner printing cartridge, a yellow toner printing cartridge, and a black toner printing cartridge;

removing said four toner printing cartridges, such that four empty toner cartridge slots are created: a cyan toner cartridge slot, a magenta toner cartridge slot, a yellow toner cartridge slot, and a black toner cartridge slot;

wherein said black toner cartridge slot is a first or fourth toner cartridge slot;

providing at least three sublimation toner printing cartridges: a cyan sublimation toner printing cartridge, a magenta sublimation toner printing cartridge, and a yellow sublimation toner printing cartridge;

providing a white replacement toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot; and installing said white replacement toner printing cartridge into said first or fourth toner cartridge slot.

5. The method of claim 4, further comprising the steps:

providing raster image processor (RIP) software for printing cartridge remapping.

6. The method of claim 5, further comprising the steps:

printing a print job onto a transfer material; and transferring said print job to a final print surface via a heat transfer;

wherein said white replacement toner printing cartridge prints in a same pass as said at least three sublimation toner printing cartridges.

7. The method of claim 4, wherein providing said at least three sublimation toner printing cartridges and said white replacement toner printing cartridge comprises the steps:

disassembling said four removed toner printing cartridges;

emptying and cleaning said four removed toner printing cartridges, such that four empty printing cartridges are created;

filling three of said four empty printing cartridges with at least three sublimation toners: a cyan sublimation toner, a magenta sublimation toner, and a yellow sublimation toner;

filling said fourth empty printing cartridge with a white replacement toner.

8. The method of claim 7, wherein said white replacement toner printing cartridge is a regular, non-sublimation specific white toner printing cartridge.

9. The method of claim 7, wherein said white replacement toner printing cartridge is a sublimation white toner printing cartridge.

10. The method of claim 4, wherein said white replacement toner printing cartridge is a regular, non-sublimation specific white toner printing cartridge.

11. The method of claim 4, wherein said white replacement toner printing cartridge is a sublimation white toner printing cartridge.

12. A method of converting a standard CMYK color toner printer to a CMYX sublimation color toner printer, comprising the steps:

providing a standard CMYK color toner printer, comprising four toner printing cartridges:

a cyan toner printing cartridge, a magenta toner printing cartridge, a yellow toner printing cartridge, and a black toner printing cartridge;

removing said four toner printing cartridges, such that four empty toner cartridge slots are created: a cyan toner cartridge slot, a magenta toner cartridge slot, a yellow toner cartridge slot, and a black toner cartridge slot;

wherein said black toner cartridge slot is a fourth toner cartridge slot;

providing at least three sublimation toner printing cartridges: a cyan sublimation toner printing cartridge, a magenta sublimation toner printing cartridge, and a yellow sublimation toner printing cartridge;

providing a non-standard toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot; and installing said non-standard toner printing cartridge into said fourth toner cartridge slot.

13. The method of claim 12, further comprising the steps:

providing raster image processor (RIP) software for printing cartridge remapping.

14. The method of claim 13, further comprising the steps:

printing a print job onto a transfer material; and transferring said print job to a final print surface via a heat transfer wherein said non-standard toner printing cartridge prints in a same pass as said at least three sublimation toner printing cartridges.

15. The method of claim 12, wherein providing said three sublimation toner printing cartridges comprises the steps:

disassembling said three removed toner printing cartridges;

emptying and cleaning said three removed toner printing cartridges, such that three empty printing cartridges are created;

filling said three empty printing cartridges with three sublimation toners: a cyan sublimation toner, a magenta sublimation toner, and a yellow sublimation toner.

16. The method of claim 15, further comprising the steps: wherein providing said non-standard toner printing cartridge comprises the steps:

disassembling said black removed toner printing cartridge;

emptying and cleaning said black toner printing cartridge, such that an empty printing cartridge is created; and filling said empty printing cartridge with a non-standard toner.

17. The method of claim 12, wherein said non-standard toner is selected from the group of non-standard toners consisting of: white, metallic, fluorescent, light, clear, clear fluorescent, ceramic, and sublimation.

18. A method of converting a standard CMYKW color toner printer to a CMYKW sublimation color toner printer, comprising the steps:

providing a standard CMYKW color toner printer, comprising five toner printing cartridges: a cyan toner printing cartridge, a magenta toner printing cartridge, a yellow toner printing cartridge, a black toner printing cartridge; and a white toner printing cartridge;

removing said five toner printing cartridges, such that five empty toner cartridge slots are created: a cyan toner cartridge slot, a magenta toner cartridge slot, a yellow toner cartridge slot, a black toner cartridge slot, and a white toner cartridge slot;

providing five sublimation toner printing cartridges: a cyan sublimation toner printing cartridge, a magenta sublimation toner printing cartridge, a yellow sublimation toner printing cartridge, a black sublimation toner printing cartridge, and a white sublimation toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot;

installing said black sublimation toner printing cartridge into said black toner cartridge slot; and installing said white sublimation toner printing cartridge into said white toner cartridge slot.

19. The method of claim 18, further comprising the steps:

providing raster image processor (RIP) software for printing cartridge remapping.

20. The method of claim 19, further comprising the steps:

printing a print job onto a transfer material; and transferring said print job from said transfer material to a final print surface via a heat transfer;

wherein said white sublimation toner printing cartridge prints in a same pass as said other four sublimation toner printing cartridges.

21. The method of claim 19, further comprising the steps:

printing a print job onto a transfer material;

wherein a layer of white is overprinted on said print job in a single pass;

transferring said print job from said transfer material to a final print surface via a heat transfer, such that said layer of white is under said print job on said final print surface.

22. The method of claim 18, wherein the step of providing said five sublimation toner printing cartridges comprises said steps:

disassembling said five removed toner printing cartridges;

emptying and cleaning said five removed toner printing cartridges, such that five empty printing cartridges are created;

filling said five empty printing cartridges with five sublimation toners: a cyan sublimation toner, a magenta sublimation toner, a yellow sublimation toner, a black sublimation toner, and a white sublimation toner.

23. A method of converting a standard CMYKX color toner printer to a CMYKX sublimation color toner printer, comprising the steps:

providing a standard CMYKX color toner printer, comprising five toner printing cartridges: a cyan toner printing cartridge, a magenta toner printing cartridge, a yellow toner printing cartridge, a black toner printing cartridge; and a non-standard toner printing cartridge;

removing said five toner printing cartridges, such that five empty toner cartridge slots are created: a cyan toner cartridge slot, a magenta toner cartridge slot, a yellow toner cartridge slot, a black toner cartridge slot, and a non-standard toner cartridge slot;

providing at least five sublimation toner printing cartridges: a cyan sublimation toner printing cartridge, a magenta sublimation toner printing cartridge, a yellow sublimation toner printing cartridge, a black sublimation toner printing cartridge, and a non-standard sublimation toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot;

installing said black sublimation toner printing cartridge into said black toner cartridge slot; and installing said non-standard toner printing cartridge into said non-standard toner cartridge slot.

24. The method of claim 23, further comprising the steps:

providing raster image processor (RIP) software for printing cartridge remapping.

25. The method of claim 23, further comprising the steps:

printing a print job onto a transfer material; and transferring said print job from said transfer material to a final print surface via a heat transfer wherein said non-standard sublimation toner printing cartridge prints in a same pass as said other four sublimation toner printing cartridges.

26. The method of claim 23, wherein the step of providing said five sublimation toner printing cartridges comprises said steps:

disassembling said five removed toner printing cartridges;

emptying and cleaning said five removed toner printing cartridges, such that five empty printing cartridges are created;

filling said five empty printing cartridges with five sublimation toners: a cyan sublimation toner, a magenta sublimation toner, a yellow sublimation toner, a black sublimation toner, and a non-standard sublimation toner printing cartridge.

27. The method of claim 23, wherein said non-standard toner is selected from the group of non-standard toners consisting of: white, metallic, fluorescent, light, clear, clear fluorescent, ceramic, and sublimation.

28. A method of converting a standard CMYKW color toner printer to a CMYKW sublimation color toner printer, comprising the steps:

providing a standard CMYKW color toner printer, comprising five toner printing cartridges: a cyan toner printing cartridge, a magenta toner printing cartridge, a yellow toner printing cartridge, a black toner printing cartridge; and a white toner printing cartridge;

removing at least four toner printing cartridges, such that four empty toner cartridge slots are created: a cyan toner cartridge slot, a magenta toner cartridge slot, a yellow toner cartridge slot, and a black toner cartridge slot;

providing at least four sublimation toner printing cartridges: a cyan sublimation toner printing cartridge, a magenta sublimation toner printing cartridge, a yellow sublimation toner printing cartridge, and a black sublimation toner printing cartridge;

installing said cyan sublimation toner printing cartridge into said cyan toner cartridge slot;

installing said magenta sublimation toner printing cartridge into said magenta toner cartridge slot;

installing said yellow sublimation toner printing cartridge into said yellow toner cartridge slot; and installing said black sublimation toner printing cartridge into said black toner cartridge slot.

29. The method of claim 28, further comprising the steps:

providing raster image processor (RIP) software for printing cartridge remapping.

30. The method of claim 29, further comprising the steps:

printing a print job onto a transfer material; and transferring said print job from said transfer material to a final print surface via a heat transfer;

wherein said white toner printing cartridge prints in a same pass as said at least four sublimation toner printing cartridges.

31. The method of claim 29, further comprising the steps:

printing a print job onto a transfer material;

wherein a layer of white is overprinted on said print job in a single pass;

transferring said print job from said transfer material to a final print surface via a heat transfer, such that said layer of white is under said print job on said final print surface.

32. The method of claim 28, wherein the step of providing said four sublimation toner printing cartridges comprises said steps:

disassembling said four removed toner printing cartridges;

emptying and cleaning said four removed toner printing cartridges, such that four empty printing cartridges are created;

filling said four empty printing cartridges with four sublimation toners: a cyan sublimation toner, a magenta sublimation toner, a yellow sublimation toner, and a black sublimation toner.

* * * * *